US010570472B2

(12) United States Patent
Rotole et al.

(10) Patent No.: US 10,570,472 B2
(45) Date of Patent: Feb. 25, 2020

(54) METHOD OF ANNEALING STEEL SHEETS

(71) Applicant: ARCELORMITTAL

(72) Inventors: John Rotole, Valparaiso, IN (US); Jonas Staudte, Montigny-les-Metz (FR); Jean-Michel Mataigne, Senlis (FR)

(73) Assignee: ArcelorMittal, Luxembourg (LU)

( * ) Notice: Subject to any disclaimer, the term of this patent is extended or adjusted under 35 U.S.C. 154(b) by 688 days.

(21) Appl. No.: 15/102,118

(22) PCT Filed: Dec. 10, 2013

(86) PCT No.: PCT/US2013/074182
§ 371 (c)(1),
(2) Date: Jun. 6, 2016

(87) PCT Pub. No.: WO2015/088501
PCT Pub. Date: Jun. 18, 2015

(65) Prior Publication Data
US 2016/0304980 A1 Oct. 20, 2016

(51) Int. Cl.

| | |
|---|---|
| ***C21D 9/46*** | (2006.01) |
| ***C23C 8/14*** | (2006.01) |
| ***C22C 38/38*** | (2006.01) |
| ***C21D 1/26*** | (2006.01) |
| ***C23C 2/06*** | (2006.01) |
| ***C23C 2/28*** | (2006.01) |
| ***C23C 8/18*** | (2006.01) |
| ***C21D 1/68*** | (2006.01) |
| ***C21D 8/02*** | (2006.01) |
| ***C23C 2/02*** | (2006.01) |
| ***C23C 8/80*** | (2006.01) |
| ***C21D 6/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/26*** | (2006.01) |
| ***C22C 38/28*** | (2006.01) |
| ***C22C 38/32*** | (2006.01) |
| ***C23C 2/40*** | (2006.01) |
| *C21D 1/76* | (2006.01) |
| *C21D 9/56* | (2006.01) |

(52) U.S. Cl.
CPC ..... *C21D 9/46* (2013.01); *C21D 1/26* (2013.01); *C21D 1/68* (2013.01); *C21D 6/002* (2013.01); *C21D 6/005* (2013.01); *C21D 6/008* (2013.01); *C21D 8/0278* (2013.01); *C22C 38/02* (2013.01); *C22C 38/04* (2013.01); *C22C 38/06* (2013.01); *C22C 38/12* (2013.01); *C22C 38/26* (2013.01); *C22C 38/28* (2013.01); *C22C 38/32* (2013.01); *C22C 38/38* (2013.01); *C23C 2/02* (2013.01); *C23C 2/06* (2013.01); *C23C 2/28* (2013.01); *C23C 2/40* (2013.01); *C23C 8/14* (2013.01); *C23C 8/18* (2013.01); *C23C 8/80* (2013.01); *C21D 1/76* (2013.01); *C21D 9/56* (2013.01)

(58) Field of Classification Search
CPC . C21D 1/26; C21D 1/76; C21D 6/002; C21D 6/005; C21D 6/008; C21D 9/46; C21D 9/56; C23C 8/14; C23C 8/18; C23C 8/80; C22C 38/02; C22C 38/04; C22C 38/06; C22C 38/12; C22C 38/26; C22C 38/28; C22C 38/32; C22C 38/38
See application file for complete search history.

(56) References Cited

U.S. PATENT DOCUMENTS

| | | | |
|---|---|---|---|
| 3,925,579 | A | 12/1975 | Flinchum et al. |
| 6,398,884 | B1 | 6/2002 | Kyono et al. |
| 8,652,275 | B2 | 2/2014 | Leuschner et al. |
| 9,340,859 | B2 | 5/2016 | Miyata et al. |
| 2007/0051438 | A1 | 3/2007 | Honda et al. |
| 2009/0123651 | A1 | 5/2009 | Okada |
| 2010/0186854 | A1 | 7/2010 | Bertrand et al. |
| 2010/0193081 | A1 | 8/2010 | Mataigne et al. |
| 2010/0304183 | A1 | 12/2010 | Honda et al. |
| 2012/0186707 | A1 | 7/2012 | Hirasawa et al. |
| 2016/0017452 | A1* | 1/2016 | Puerta Velasquez ..... B32B 15/012 148/531 |
| 2018/0119263 | A1 | 5/2018 | Kim et al. |

FOREIGN PATENT DOCUMENTS

| | | | |
|---|---|---|---|
| BE | 1014997 | A3 | 8/2004 |
| EP | 1076105 | A1 | 2/2001 |
| EP | 2009129 | A1 | 12/2008 |

(Continued)

OTHER PUBLICATIONS

Koll, T et al.; "Enhancing the wettability of High Strength Steels during Hot-Dip galvanizing," Galvatech '04: 6th International Conference on Zinc and Zinc Alloy Coated Steel Sheet, Jan. 1, 2004, pp. 795-802, Chicago, IL, USA.

*Primary Examiner* — Lois L Zheng
(74) *Attorney, Agent, or Firm* — Davidson, Davidson & Kappel, LLC

(57) ABSTRACT

A method of annealing of steel sheets is provided which includes a first step consisting in fully oxidizing the surface of such steel sheet thus creating a fully oxided surface layer, a second step consisting in selectively oxidizing elements other than iron of such steel, in an area extending under said fully oxided layer, thus creating a selectively oxided internal layer and a third step consisting in fully reducing said fully oxided surface layer.

20 Claims, No Drawings

(56) References Cited

FOREIGN PATENT DOCUMENTS

| | | | |
|---|---|---|---|
| JP | 2000309847 | A | 11/2000 |
| JP | 2001279412 | A | 10/2001 |
| JP | 2006233333 | A | 9/2006 |
| JP | 2007277627 | A | 10/2007 |
| JP | 2010532820 | A | 10/2010 |
| JP | 2012149307 | A | 8/2012 |
| JP | 2012251192 | A | 12/2012 |
| JP | 2015504976 | A | 2/2015 |
| RU | 59061 | U1 | 12/2006 |
| RU | 2367714 | C2 | 9/2009 |
| RU | 2418094 | C2 | 5/2011 |
| RU | 2456370 | C2 | 7/2012 |

* cited by examiner

METHOD OF ANNEALING STEEL SHEETS

FIELD OF THE INVENTION

This invention pertains to a method of annealing of steel sheets. More particularly, it pertains to method of annealing of steel sheets before hot dip coating and possibly before galvannealing treatment.

BACKGROUND

The demand for increased light weighting in cars requires more sophisticated alloying concepts for high strength steels, by increasing mechanical resistance and by even lowering density. Alloying elements such as aluminum, manganese, silicon and chromium are first choice, but create severe problems in coatability caused by the presence of alloying elements oxides on the surface after annealing.

During heating the steel surface is exposed to an atmosphere which is non-oxidizing for iron but oxidizing for alloying elements with a high affinity towards oxygen such as manganese, aluminum, silicon, chromium, carbon or boron, which will provoke the formation of oxides of those elements at the surface. When the steel contains such oxidable elements, they tend to be selectively oxided at the surface of the steel, impairing wettability by the subsequent coating.

Moreover, when such coating is a hot dip coated steel sheet that is further heat treated for galvannealing, the presence of such oxides may impair the diffusion of iron in the coating which can not be sufficiently alloyed at the classical line speeds of an industrial line.

SUMMARY

The present invention provides a method of annealing of steel sheets comprising:

- a first step consisting in fully oxidizing the surface of such steel sheet thus creating a fully oxided surface layer,
- a second step consisting in selectively oxidizing elements other than iron of such steel, in an area extending under said fully oxided layer, thus creating a selectively oxided internal layer and
- a third step consisting in fully reducing said fully oxided surface layer.

In a first embodiment, such method can be carried on in a facility comprising a direct flame heating zone, a radiant tubes heating zone and a radiant tubes soaking zone, the first step being performed in the direct flame heating zone, the second step being performed at least in the radiant tubes heating zone and the third step being performed at least in the radiant tubes soaking zone. The first step can be performed by regulating the direct flame heating zone atmosphere to an air/gas ratio above 1.

In another embodiment, such method can be carried on in a facility comprising a radiant tubes preheating zone, a radiant tubes heating zone and a radiant tubes soaking zone, the first step being performed in the radiant tubes preheating zone, the second step being performed at least in the radiant tubes heating zone and the third step being performed at least in the radiant tubes soaking zone. The first step can be performed in an oxidizing chamber containing an amount of O2 of 0.1 to 10 vol %, preferably of 0.5 to 3 vol %. Alternatively or in combination, the oxidizing chamber may receive water injection so as to be oxidizing for iron.

In another embodiment, the second step is performed by setting the dew point of the radiant tubes heating zone above a critical value depending on the H2 content of the atmosphere of such zone. The dew point may be regulated through injection of water vapor.

In another embodiment, the third step of reduction is performed by using an atmosphere containing at least 2 vol % H2, balance being N2. A preferred maximum amount of H2 is 15 vol %.

DETAILED DESCRIPTION

An annealed steel sheet obtained according to the invention can be hot dip coated by dipping in a zinc bath and possibly heat treated at a temperature from 450° C. to 580° C. during 10 to 30 seconds, and preferably under 490° C. to produce a so-called galvannealed steel sheet.

There is no practical limitation to the nature of the steel that can be treated according to the invention. However, it is preferred that such steel contains a maximum of 4 wt % of manganese, of 3 wt % of silicon of 3 wt % of aluminium and of 1 wt % of chromium, to ensure optimal ability to be coated.

During heating the steel surface is first exposed to an oxidizing atmosphere, which will provoke the formation of iron oxide at the surface (so called total oxidation). This iron oxide prevents the alloying elements to be oxidized at the steel surface.

Such first step can be performed in a direct fire furnace (DFF) used as a pre-heater. The oxiding power of such equipment is regulated by setting the air/gas ratio above 1.

Such first step can alternatively be performed in a radiant tubes furnace (RTF) preheating zone. In particular, such RTF preheating zone can include an oxiding chamber containing an oxiding atmosphere. Another alternative is to set the whole preheating section under oxidizing atmosphere using either O2 and/or H2O as oxygen donator.

After generation of such surface oxidation layer, a second step of selective oxidation of elements other than iron takes places. Those elements are the most easily oxidable elements contained in the steel, such as manganese, silicon, aluminium, boron or chromium. Such second step is performed by assuring an oxygen flow into the bulk of the steel sheet, provoking thus internal selective oxidation of the alloying elements.

In the frame of the present invention, such oxidation can be performed by controlling the dew point of the RTF heating zone above a minimal value depending on the H2 content of the atmosphere of such heating zone. Injecting water vapour is one of the methods that can be applied to control dew points to the desired value. It has to be noted that reducing the H2 content of the atmosphere will allow injecting less water vapour as dew points can be decreased as well, while still obtaining selective oxidation.

In a third step, the fully oxided layer must be reduced thus guaranteeing further coatability by any kind of coatings such as phosphatation, electrodeposited coatings, vacuum coatings including jet vapour deposition coatings, hot dip Zn coatings, etc. Such reduction can occur at the end of the RTF heating zone and/or during soaking and/or during cooling of the steel sheet. It can be carried on using classical reduction atmospheres and methods, known to the man skilled in the art.

The present invention will be better understood through detailed disclosure of some non limiting examples.

EXAMPLES

Steel sheets made of steels with different compositions, as gathered in table 1, were produced in a classical way until being cold rolled. They were then annealed in a facility comprising a DFF heating furnace, followed by a RTF heating furnace comprising two different zones, namely a RTF heating zone and a RTF soaking zone. Dew points of the RTF heating zone were regulated through setting of different DFF heating zone exit temperatures and injecting steam at different rates. Annealing parameters are gathered in table 2.

After soaking, the annealed steel sheets were cooled by classical jet coolers until reaching a temperature of 480° C.

The steel sheets were then dipped in a zinc pot containing aluminium in an amount of 0.130 wt % and submitted to a galvannealing treatment through induction heating at a temperature of 580° C. during 10 seconds.

Coated steel sheets were then examined and corresponding iron contents of the coatings were evaluated. Results of such evaluation are also gathered in table 2.

TABLE 1

| Steel compositions | | | | | | | | | |
|---|---|---|---|---|---|---|---|---|---|
| Grade | C | Mn | Si | Al | Cr | Mo | Ti | Nb | B |
| A | 0.13 | 2.5 | 0.7 | — | 0.3 | — | 0.02 | 0.01 | 0.002 |
| B | 0.2 | 1.8 | 2.0 | 0.65 | — | — | — | — | — |
| C | 0.2 | 2.2 | 2.0 | 0.5 | — | 0.15 | — | 0.015 | — |

TABLE 2

| Annealing parameters - Coating evaluations | | | | | | | |
|---|---|---|---|---|---|---|---|
| Trial | Grade | DFF exit T (° C.) | Steam rate (kg/hr) | Maximal Dew point (° C.) | H2 (%) | Alloying | Iron content (%) |
| 1 | A | 649 | 0 | −10 | 6 | None | 0 |
| 2 | B | 716 | 2.5 | 8 | 6 | Partial | ne |
| 3 | C | 716 | 5 | 20 | 6 | Full | 12 |

ne: not evaluated

Trial no 1 exhibited a highly reflective GI-type unalloyed surface. Processing of Trial no 2 using an insufficient dew point resulted in random differential alloy across the full width evident to some degree through the coil length. The dew point value was further increased during Trial no 3. This resulted in a fully alloyed strip surface all along the coil length.

Another advantage of the method according to the invention is that, by increasing the dew point of the RTF heating zone allowing the corresponding switch from an external to internal mode of selective oxidation appears to have also favorably impacted the decarburization kinetics of the steel sheets. This was demonstrated by monitoring the CO content of the atmosphere of such zone that was reduced.

The invention claimed is:

1. A method of annealing steel sheets comprising:

a first step including fully oxidizing a surface of a steel sheet thereby creating a fully oxided surface layer; thereafter, a second step including selectively oxidizing elements other than iron in said steel sheet, in an area extending under said fully oxided surface layer, thereby creating a selectively oxided internal layer by assuring an oxygen flow into the bulk of the steel; and thereafter a third step including fully reducing said fully oxided surface layer.

2. A method of annealing steel sheets according to claim 1, wherein said method is performed in a facility comprising a direct flame heating zone, a radiant tubes heating zone and a radiant tubes soaking zone; and wherein said first step is performed in the direct flame heating zone, said second step is performed at least in the radiant tubes heating zone, and said third step is performed at least in the radiant tubes soaking zone.

3. A method of annealing steel sheets according to claim 2, wherein said first step comprises regulating said direct flame heating zone atmosphere to an air/gas ratio above 1.

4. A method of annealing steel sheets according to claim 1, wherein said method is performed in a facility comprising a radiant tubes preheating zone, a radiant tubes heating zone, and a radiant tubes soaking zone; and wherein said first step is performed in the radiant tubes preheating zone, said second step is performed at least in the radiant tubes heating zone, and said third step is performed at least in the radiant tubes soaking zone.

5. A method of annealing steel sheets according to claim 4, wherein said first step is performed in an oxidizing chamber containing an amount of $O_2$ of 0.1 to 10 vol. %.

6. A method of annealing steel sheets according to claim 2, wherein said second step is performed by setting a dew point of such radiant tubes heating zone above a critical value depending on the $H_2$ content of the atmosphere of such zone.

7. A method of annealing steel sheets according to claim 6, wherein said dew point is regulated through injection of water vapor.

8. A method of annealing steel sheets according to claim 5, wherein said second step is performed by setting a dew point of such radiant tubes heating zone above a critical value depending on the $H_2$ content of the atmosphere of such zone.

9. A method of annealing steel sheets according to claim 8, wherein said third step of reduction is performed by using an atmosphere containing at least 2% $H_2$, balance being $N_2$.

10. A method of annealing steel sheets according to claim 1, wherein said third step of reduction is performed by using an atmosphere containing at least 2% $H_2$, balance being $N_2$.

11. A method of annealing steel sheets according to claim 1, wherein said steel comprises up to 4 wt % of manganese, up to 3 wt % of silicon, up to 3 wt % of aluminum and up to 1 wt % of chromium.

12. A method of production of a galvanized steel sheet wherein an annealed steel sheet obtained according to claim 1 is hot dip coated by dipping in a zinc bath.

13. A method of production of a galvannealed steel sheet wherein a galvanized steel sheet obtained according to claim 12 is further heat treated at a temperature from 450° C. to 580° C. during 10 to 30 seconds.

14. A method of production of a galvannealed steel sheet according to claim 13 wherein said heat treatment is performed under 490° C.

15. A method of annealing steel sheets according to claim 4, wherein said second step is performed by setting a dew point of such radiant tubes heating zone above a critical value depending on the $H_2$ content of the atmosphere of such zone.

16. A method of annealing steel sheets according to claim 2, wherein said third step of reduction is performed by using an atmosphere containing at least 2% $H_2$, balance being $N_2$.

17. A method of annealing of steel sheets according to claim 4, wherein said third step of reduction is performed by using an atmosphere containing at least 2% $H_2$, balance being $N_2$.

18. A method of annealing of steel sheets according to claim 3, wherein said third step of reduction is performed by using an atmosphere containing at least 2% $H_2$, balance being $N_2$.

19. A method of annealing of steel sheets according to claim 5, wherein said third step of reduction is performed by using an atmosphere containing at least 2% $H_2$, balance being $N_2$.

20. A method of annealing steel sheets comprising:

a first step consisting of fully oxidizing a surface of a steel sheet thereby creating a fully oxided surface layer; thereafter, a second step consisting of selectively oxidizing elements other than iron in said steel sheet, in an area extending under said fully oxided surface layer, thereby creating a selectively oxided internal layer by assuring an oxygen flow into the bulk of the steel; and thereafter a third step consisting of fully reducing said fully oxided surface layer.

* * * * *